US005360234A

United States Patent [19]

Miller et al.

[11] Patent Number: 5,360,234

[45] Date of Patent: Nov. 1, 1994

[54] APPARATUS FOR HOLDING PHOTOGRAPH ALBUMS AND METHOD

[75] Inventors: William R. Miller, Walnut; Mary Sarandon, Marina del Rey, both of Calif.; Janice R. Jenkins, Durham, N.C.

[73] Assignees: Rembrandt Photo Services, Commerce, Calif.; Qualex Financial Corporation, Wilmington, Del.

[21] Appl. No.: 938,402

[22] Filed: Aug. 31, 1992

[51] Int. Cl.[5] ..... B42D 3/00

[52] U.S. Cl. ..... 281/31; 281/29; 281/37; 402/70; 402/73

[58] Field of Search ..... 281/15.1, 21.1, 31, 281/37, 29; 402/70, 73; 40/159, 156

[56] References Cited

U.S. PATENT DOCUMENTS

| | | | |
|---|---|---|---|
| 1,336,438 | 4/1920 | Kraetsch . | |
| 1,432,453 | 10/1922 | Finger . | |
| 1,710,331 | 12/1926 | Aberle . | |
| 2,732,875 | 1/1956 | Martin . | |
| 2,815,126 | 12/1957 | Deckers . | |
| 2,828,975 | 4/1958 | Wright . | |
| 2,850,294 | 9/1958 | Ortis et al. . | |
| 2,878,850 | 3/1959 | Quint . | |
| 2,879,774 | 3/1959 | Siegel | 281/31 X |
| 3,116,738 | 1/1964 | Wentges . | |
| 3,360,027 | 12/1967 | Price . | |
| 3,797,146 | 3/1974 | Holes | 40/159 X |
| 3,870,223 | 3/1975 | Wyant . | |
| 4,164,085 | 8/1979 | Steeb et al. . | |
| 4,314,635 | 2/1982 | Fraser et al. | 281/31 X |
| 4,355,822 | 10/1982 | McHugh . | |
| 4,492,390 | 1/1985 | Jacobs et al. . | |
| 4,514,919 | 5/1985 | Plutsky . | |
| 4,530,176 | 7/1985 | Rejwan . | |
| 4,659,109 | 4/1987 | Donovan . | |
| 4,676,527 | 6/1987 | Palmer . | |
| 4,704,042 | 11/1987 | Eisen et al. . | |
| 4,890,728 | 1/1990 | Grimsley . | |
| 4,958,855 | 9/1990 | Shipp . | |
| 4,964,656 | 10/1990 | Prentice | 281/31 X |
| 5,040,216 | 8/1991 | Policht . | |
| 5,066,158 | 11/1991 | Huang | 281/51 X |
| 5,183,296 | 2/1993 | Policht . | |

FOREIGN PATENT DOCUMENTS 119324 12/1944 Australia .

OTHER PUBLICATIONS

U.S. patent application Ser. No. 07/761,406, S. A. Policht, "Photograph Album and Method for Making Same", filed Sep. 17, 1991.

*Primary Examiner*—Willmon Fridie
*Attorney, Agent, or Firm*—David Weiss

[57] ABSTRACT

An apparatus and method for holding photograph albums in localized association with photo negatives corresponding to the photoprints in the respective albums. The holder preferred embodiment includes three substantially rectangular panels, a first spine pivotally connecting a first one of the panels and a second one of the panels, and a second spine longitudinal parallel to the first spine pivotally connecting the second panel and a third one of the panels. Album retaining means are carried by the panels for retaining the photo albums thereon, and negatives storage means are also carried by the panels for storing photo negatives in respective localized association with the album retaining means.

29 Claims, 3 Drawing Sheets

Fig. 6.
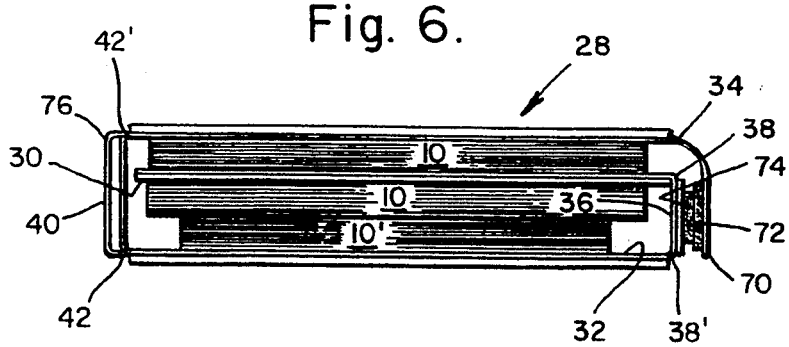
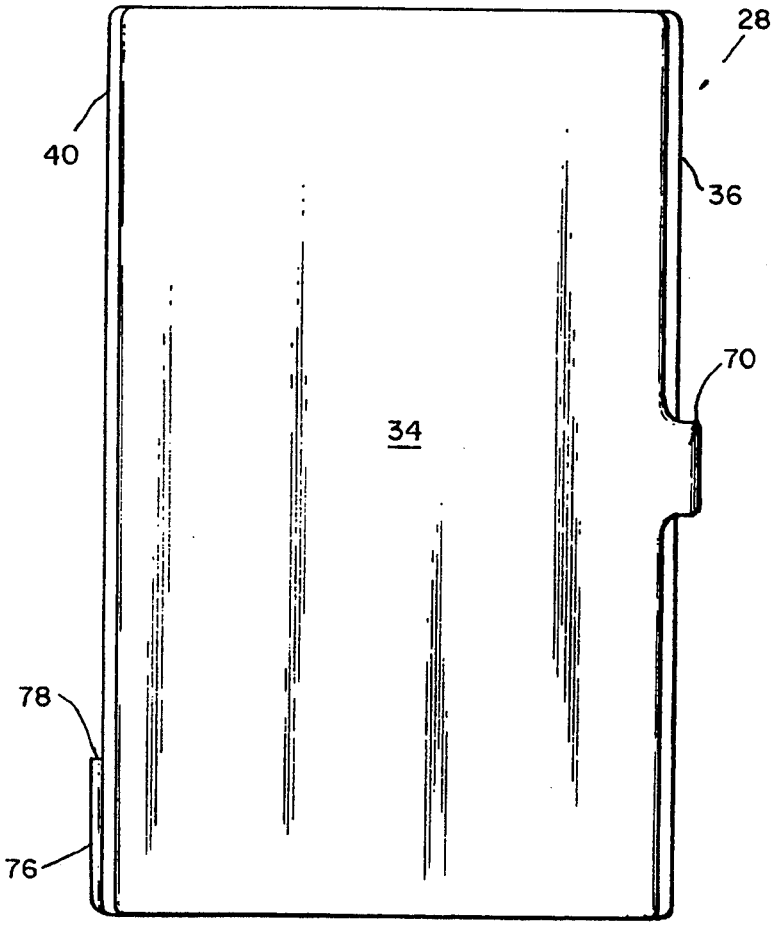
Fig. 7.
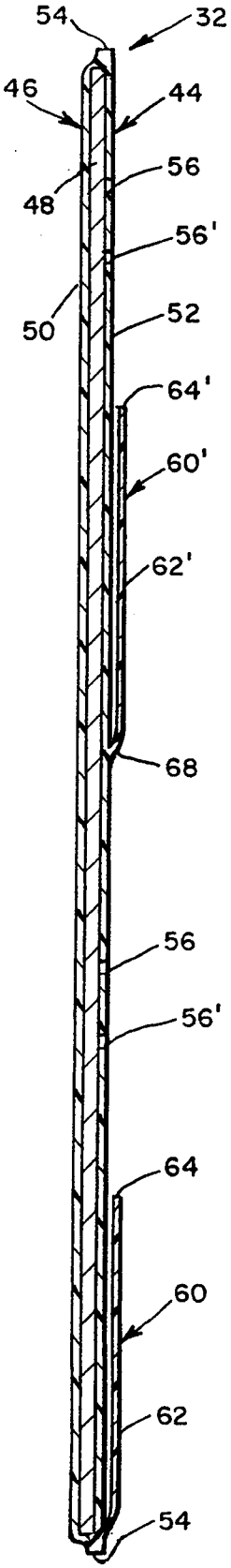
Fig. 5.

APPARATUS FOR HOLDING PHOTOGRAPH ALBUMS AND METHOD

BACKGROUND OF THE INVENTION

This invention relates to an apparatus and method for holding photograph albums in localized association with photo negatives corresponding to the photoprints in the respective albums.

U.S. Pat. No. 4,530,176, issued to Sasson Rejwan on Jul. 23, 1985, which patent and its disclosure are hereby incorporated herein by reference, teaches an apparatus for cataloguing and retrieving photographic prints and negatives stored together in a box-like case. The apparatus taught by the Rejwan patent includes a photograph album having front and rear cover leaves, an index member forming a label at the album's bound edge, a plurality of mounting tongues with photographs respectively adhesively connected thereto, and a hanger element, all held together at the top by an elastic band. The photographs are hinged with respect to the mounting tongues near the adhesive connection in order that the prints may be pivoted or flipped for permitting easy viewing thereof.

The box-like case disclosed in the Rejwan patent contains a compartment fitted with a pair of parallel, spaced support members, for receiving a plurality of such photograph albums. Each photograph album is supported in the case's album compartment by the album's hanger member resting on the compartment's horizontal support members. The case further includes another compartment for receiving a correspondingly shaped negatives album in the form of a small notebook having a plurality of plastic leaves. Each leaf forms an envelope with one open edge for receiving a paper negative/print wallet of the type customarily provided by photographic film processors. This negatives album is used for containing photo negatives corresponding to the photoprints included by all of the photo albums contained in the case's photo album compartment.

SUMMARY OF THE INVENTION

By means of the present invention, photo albums containing pluralities of photoprints—and in particular photo albums of the general type taught by the aforementioned Rejwan patent—may be catalogued, stored, retrieved and viewed with enhanced facility. Photo negatives corresponding to the photoprints in a particular one of the retained photo albums may be stored in proximity to such particular album; other photo negatives corresponding to the prints included in other retained photo albums may be stored in proximity to the respectively corresponding other ones of the retained albums.

Briefly described, the apparatus of the present invention includes a device for holding photo albums comprising in combination a plurality of substantially rectangular panels; means successively connecting the panels such that they are pivotable into a closed condition in spaced overlapping arrangement; album retaining means carried preferably by each of the panels for retaining at least one photo album on each panel; and negatives storage means carried by preferably each of the panels for storing photo negatives in respective localized association with the album retaining means. The negatives storage means preferably includes a plurality of pockets in localized association with respective ones of the album retaining means, and in the preferred embodiment the pockets respectively underlie the albums when retained by the retaining means.

The panels are preferably three in number and are successively connected by means of a first spine pivotally connecting a first one of the panels and a second one of the panels, and a second spine longitudinally parallel to the first spine pivotally connecting the second panel and a third one of the panels. Closure means may be provided for releasably securing the panels in its closed condition.

The photo album holder of the present invention has particular application for holding photo albums of the general type taught in the aforementioned Rejwan patent. Such photo albums each includes a rear cover or flap and a plurality of photoprints pivotally or hingedly depending along the flap. (It should be noted that the present invention does not require the albums to be provided with hanger members as taught by the Rejwan patent; accordingly, this feature may be omitted from the type of album for being retained by the album holder of the present invention.)

In the preferred embodiment of the present album holder, each of the album retaining means includes at least one receiving means for receiving a rear flap included by a one of the photo albums for releasably retaining the album on a one of the panels. Each of the three panels includes a substantially rectangular rigid core having a surface which is nonadhesively covered by a flexible sheet, and each of the album retaining means includes at least one slit in the sheet for receiving a flap between the sheet and the core surface for releasably retaining the album on the panel.

The method for storing photoprints and their corresponding photo negatives according to the present invention comprises the steps of providing a plurality of photo albums each including a plurality of photoprints; providing a plurality of photo negative packages each including photo negatives respectively corresponding to the photoprints of respective ones of the photo albums; providing a photo album holder according to the apparatus of the present invention, which in its preferred embodiment, comprises three substantially rectangular panels, a first spine pivotally connecting a first one of the panels and a second one of the panels, a second spine longitudinally parallel to the first spine pivotally connecting the second panel and a third one of the panels, a plurality of retaining means carried by the panels for cooperating with the photo albums for retaining respective ones of the albums on the panels, and a plurality of pockets carried by the panels in localized association with respective ones of the retaining means; engaging a one of the photo albums with a one of the retaining means for being retained on a one of the panels; selecting a one of the photo negatives packages including photo negatives corresponding to the photoprints of the one retained photo album; and inserting the one selected photo negatives package in the one of the pockets in localized association with the one retained photo album.

The pockets of the provided photo album holder are carried by the panels such that the pockets respectively underlie ones of the albums when retained by the retaining means, and during the negatives insertion step the selected negatives package is inserted in the one of the pockets underlying the one retained album.

The method further includes the steps of engaging other ones of the photo albums with respective other ones of the retaining means for being retained on the panels; selecting other ones of the photo negatives packages respectively including photo negatives corresponding to the photoprints of the other retained photo albums; and inserting the other ones of the selected photo negatives packages in the ones of the pockets underlying the respectively corresponding other ones of the retained photo albums.

When the desired number of photo albums are retained on the panels along with the photo negatives corresponding to the prints contained in the respective photo albums and in localized association therewith, i.e. in the respective pockets underlying the corresponding retained albums, the album holder may be placed into its closed condition by pivoting the first panel along the first spine for overlapping the second panel with the photo albums and their associated photo negatives retained on the first and second panels being contained within the space between the overlapping first and second panels; and pivoting the third panel along the second spine for overlapping the first panel with the photo albums and their associated photo negatives retained on the third panel being contained within the space between the overlapping third and first panels. The holder may be releasably secured in its closed condition by closure means which may be implemented by a strap extending from the free longitudinal edge of the third panel for being releasably secured to the outer surface of the first spine.

BRIEF DESCRIPTION OF THE DRAWINGS

The novel features which are believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

FIG. 5 is a cross-sectional elevation view of the photo album holder of FIG. 3, taken along the line 5—5 in the direction of the appended arrows;

FIG. 6 is a bottom view of the preferred embodiment of the photo album holder in its closed condition, with photo albums shown contained therein;

FIG. 7 is a front elevation view of the preferred embodiment of the photo album holder in its closed condition;

DETAILED DESCRIPTION OF THE PREFERRED EMBODIMENT

Figure 1:
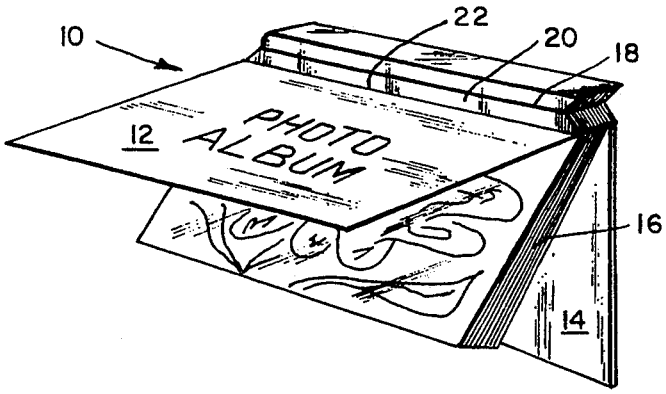
Fig. 1 (Prior Art)
FIG. 1 is a perspective view of a prior art photo-print album of a type which may be conveniently accommodated by the photo album holder of the present invention, the photo album shown in a partially opened condition.

Turning first to FIG. 1, there is shown a photograph album 10 of the type described in the aforementioned U.S. Pat. No. 4,530,176 incorporated herein by reference, but without the hanger member disclosed in said patent. The photo album 10 is of generally rectangular configuration, and comprises a substantially rectangular front cover leaf 12, a substantially rectangular rear flap or cover leaf 14, a plurality of substantially rectangular photoprints 16 of common dimensions stacked between the cover leaves 12, 14, all held together at the top by an elastic band 18 cooperating with binder members 20 hingedly secured to the cover leaves 12, 14 and to the prints 16 along one of their respective edges of common dimension indicated at 22. Accordingly, the plurality of photoprints 16 effectively pivotally or hingedly depend from or along the rear flap or cover leaf 14. Although preferably exhibiting flexibility for reasons which will become evident, the rear cover leaf 14 is preferably of greater stiffness than the typical print paper of the photo prints 16; for example, the rear cover leaf 14 may be made from paper stock having a gauge thickness of 10 or 20 mil.

Figure 2:
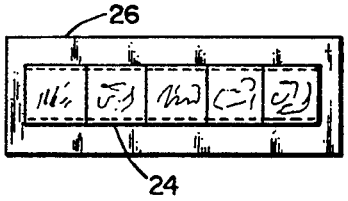
Fig. 2. (Prior Art)
FIG. 2 is a front elevation view of a prior art photo negatives package of a type which may be conveniently accommodated by the photo album holder of the present invention.

FIG. 2 is illustrative of a typical strip of photo negatives 24 situated within a protective sleeve 26, a practice well known to the photographic art. The negatives strip 24 includes frames corresponding to photoprints 16 included in the photo album 10 of FIG. 1. The present invention comprises a method and apparatus for holding photoprint albums such as of the type shown in FIG. 1 together with photo negatives (as shown for example in FIG. 2) corresponding to the photo prints 16 contained within particular ones of the photo albums and in close spatial arrangement or localized association with such particular photo albums respectively.

Figure 3:
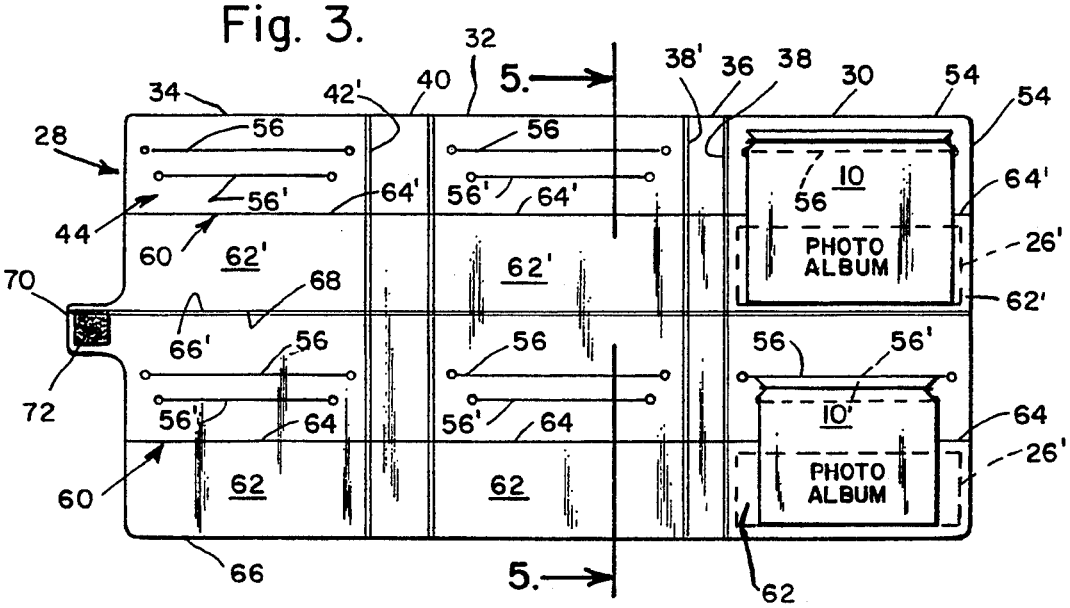
FIG. 3 is an elevation view of an inner face of a preferred embodiment of a photo album holder of the present invention, in its open condition, with two photo albums and negatives packages shown thereon.
Figure 4:
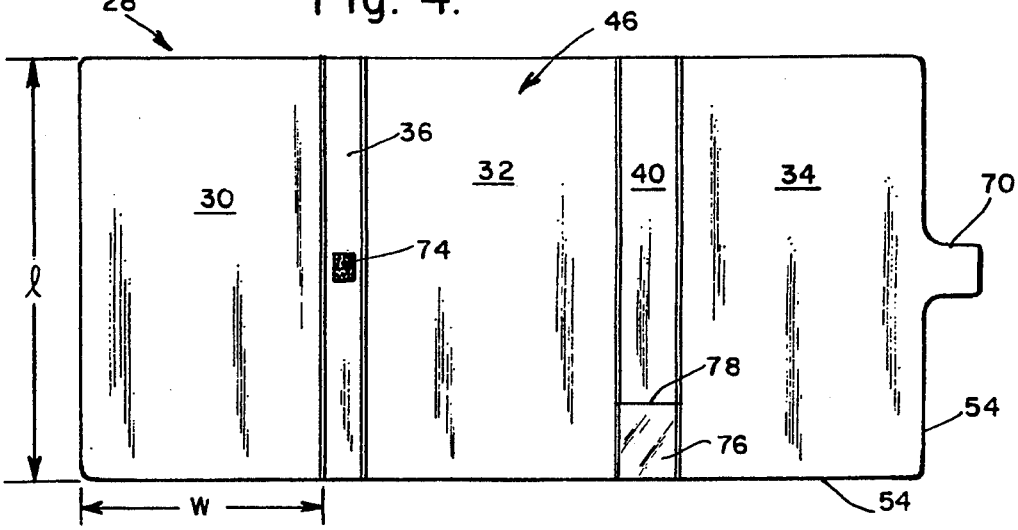
FIG. 4 is an elevation view of the outer surface of the album holder of FIG. 3, in its open condition.

As shown in FIGS. 3 and 4, the preferred embodiment of the album holder 28 of the present invention includes a first substantially rectangular panel 30, a second substantially rectangular panel 32 and a third substantially rectangular panel 34. Each of the three panels 30, 32, 34 are of substantially the same dimensions, and in one example of the preferred embodiment 28 each panel's longitudinal dimension 1 is approximately eleven and one-quarter inches while each panel's transverse or width dimension w (as shown in the drawing) is approximately six and three-quarters inches.

A first longitudinal spine 36 pivotally connects the first panel 30 and the second panel 32 along their longitudinal dimension, by means of longitudinal hinges 38, 38' along opposite longitudinal edges respectively of the spine 36 pivotally or hingedly connecting a longitudinal edge of the first panel 30 along a longitudinal edge of the spine 36 and pivotably or hingedly connecting a longitudinal edge of the second panel 32 along the other longitudinal edge of the first spine 36. Similarly, a second spine 40 (which is longitudinally parallel to the first spine 36) pivotally connects the second panel 32 and the third panel 34 along their longitudinal dimension, by means of longitudinal hinges 42, 42' along opposite longitudinal edges respectively of the second spine 40 pivotally or hingedly connecting the other longitudinal edge of the second panel 32 along an edge of the second spine 40 and pivotally or hingedly connecting a longitudinal edge of the third panel 34 along tire other longitudinal edge of the second spine 40.

When in its open condition, the photo album holder 28 has a first or "inner" face 44 as shown in FIG. 3, and a second or "outer" face 46 as shown in FIG. 4. Each of the panels 30, 32, 34 is fabricated of a rigid, substantially rectangular core member 48 (see FIG. 5), such as a rectangular sheet of rigid cardboard or chipboard, and each of the spines 36, 40 is fabricated as well from a rigid, substantially rectangular core material such as cardboard or chipboard. The arrangement of panel cores and spine cores is covered with and sandwiched between a flexible and durable cover sheet material such as vinyl.

The construction of each of the three panels is represented by the longitudinal cross-section of the second panel 32 shown in FIG. 5. The panel's outer face 46 comprises a first vinyl cover sheet 50 covering the "outer" face or surface of the rectangular core member 48, and the panel's inner face 44 includes a second vinyl cover sheet 52 covering the "inner" face or surface of the panel's core member 48. The cover sheets 50, 52 respectively extend as well over the inner and outer surfaces of the core members of the two spines 36, 40. Although the first cover sheet 50 may be glued to the outer surfaces of the rigid cores, if desired, the second cover sheet 52 is applied to the inner surfaces of the panel cores 48 without glue such that a free space may be available between the inner surfaces of the panel's core members 48 and the flexible inner cover sheet 52. The edges of the first vinyl cover sheet 50 are secured to the corresponding edges of the second vinyl cover sheet 52 with the five core members sandwiched therebetween, by means of a welded heat seal 54 about the entire periphery of the photo album holder 28. The hinges 38, 38' 42, 42' (see FIGS. 3 and 4) are created by longitudinal heat seals welding together the first and second vinyl sheets 50, 52 between the slightly spaced-apart longitudinal edges of the appropriate panel and spine core members. Heat sealing or welding techniques for forming the seals 54, 38, 38' 42, 42' are well known in the thermoplastic welding art.

As shown in FIGS. 3 and 5, the inner face 44 of each of the panels 30, 32, 34 includes pairs of transverse slits 56, 56' through the second or inner vinyl cover sheet 52. The width of these slits 56, 56' , and their longitudinal positioning on the panels 30, 32, 34, are selected for accommodating the retaining on the panels of photo albums 10 of the type shown in FIG. 1. It may be appreciated that a rear cover leaf 14 of an album 10 (or other flap appended at the rear of the album) may be inserted in the slit 56 and may be urged to proceed downwardly (as viewed in FIG. 5) between the flexible inner vinyl cover sheet 52 and the rigid core member 48. In the preferred photo album holder embodiment, the slits 56 are approximately six inches wide (terminating with circular apertures for preventing tearing at the slit ends) for accommodating photo albums 10 containing prints which are nominally six inches wide and four inches high. Second transverse slits 56' are respectively located longitudinally just below (approximately one-half inch) the slits 56; the slits 56' are approximately five inches in width (terminating with circular apertures for preventing tearing at the slit ends) for accommodating photo albums 10' containing photo prints which are nominally five inches wide by three and one-half inches high. Two pairs of transverse slits 56, 56' are longitudinally spaced on each panel such that when two albums 10 and/or 10' are retained by a panel (one photo album 10 or 10' for each pair of slits 56, 56' on the panel), the two retained photo albums are situated in the same plane one longitudinally above the other and completely contained within the edges of that panel (as shown in FIG. 3). In the preferred embodiment, the two transverse first slits 56 are longitudinally situated on each panel approximately one-inch and seven inches respectively below the panel's top edge.

A first vinyl pocket strip 60 transversely extends over the bottom portion of the inner vinyl sheet 52 with the bottom edge 66 of the strip 60 aligned with the bottom edge of the first vinyl sheet 60. The strip 60 is secured along the bottom and longitudinal edges of each of the panels 30, 32, 34, for creating pockets 62 having pocket openings 64. Securing of the strip 60 is preferably accomplished by the thermoplastic welding processes utilized to produce the peripheral seal 54 and the longitudinal seals 38, 38', 42, 42'.

A second vinyl pocket strip 60' transversely extends across the inner vinyl sheet 52 and is secured to the longitudinal edges of each of the panels 30, 32, 34. The bottom edge 66' of the second vinyl strip 60' is situated slightly above (as viewed in FIGS. 3 and 5) one-half the height of the panels, say approximately five and one-quarter inches below the top edge of the panels as viewed in FIGS. 3 and 5, and is welded to the inner vinyl sheet 52 by means of a transverse bar seal 68, thereby completing the formation of pockets 62' with pocket openings 64'.

The dimensions of each of the pockets 62, 62' are sufficiently great for accommodating storage of the photo negatives corresponding to the photo prints in an associated photo album 10, 10' retained in the album holder 28. The stored photo negatives packages may be in the form of photo negative strips 24 contained in their protective sleeves 26 as illustrated in FIG. 2, and accordingly the pockets 62, 62' transversely extend over each of the panels 30, 32, 34 and have dimensions of approximately six and three-quarter inches wide (in the transverse direction) and approximately two and one-half inches high (in the longitudinal direction) for containment of such photo negatives packages.

The photo negatives pockets 62, 62' are respectively positioned on each of the panels 30, 32, 34 in proximity to and longitudinally slightly below (as viewed in FIGS. 3 and 5) the pairs of slits 56, 56'. In the preferred album holder 28, the respective transverse pocket openings 64, 64' are parallel to the album retaining slits 56, 56' and are respectively longitudinally situated approximately one and three-quarter inches below the higher positioned wider slit 56.

It may be readily appreciated that such positioning of the photo negatives pockets 62, 62' on the panels 30, 32, 34 results in a photo negatives pocket underlying or situated directly beneath (i.e. perpendicularly into the plane of the drawing of FIG. 3) a photoprint album 10 or 10' (i.e., the photoprints 16 of a retained album 10 or 10' overlie a photo negatives pocket 62 or 62') when the rear flap or cover 14 of such photoprint album is retained by one of the slits 56, 56' associated with that pocket 62 or 62', as indicated in FIG. 3. Accordingly, the photo negatives corresponding to the photoprints contained in a particular photo album 10, 10' retained by one of the slits in a particular slit pair 56, 56' may be stored in the particular photo negatives pocket 62 or 62' associated with that slit pair and therefore with that particular retained photo album 10 or 10', as indicated in FIG. 3 by the photo negatives packages 26' shown in phantom (each of which may include one or more sleeved photo negative strips 24, 26).

In use, and in practicing the method of the present invention, as many as six photo albums 10, 10' may be retained on the three panels 30, 32, 34 along with their respectively corresponding photo negatives in localized association therewith; i.e., two photoprint albums 10, 10' and their respectively associated photo negatives packages 26' may be retained by each of the three panels as represented in FIG. 3 by the first panel 30. When the album holder 28 is in its open condition as shown in FIG. 3, the photo albums and/or their associated photo negatives may be inserted into or removed from the holder 28. Of course, in such open condition, an album's photoprints may be viewed by pivoting the album's front cover 12 and the prints 16 along the album leaves' top hinges 22. A particular photo negatives package 26' may be inserted into or removed from its pocket 62, 62' by either removing the associated photo album 10, 10' or by upwardly flipping the front cover leaf 12 and all of the prints 16 of the retained photo album for providing access to the associated pocket.

FIGS. 6 and 7 show the photo album holder 28 in its closed condition, with FIG. 6 indicating albums 10, 10' contained therein. In closing the album 28 from its open condition of FIG. 3, the first panel 30 is pivoted counterclockwise along the first spine longitudinal hinges 38, 38' for overlapping the second panel 32 with the inner faces 44 of both panels 30, 32 obverse one another. The third panel 34 may then be pivoted clockwise along the second spine longitudinal hinges 42', 42 for overlapping the first panel 30 with the inner face 44 of the third panel 34 obverse the outer face 46 of the first panel 30.

The width of the spines 36, 40, along their associated hinges 38, 38' and 42, 42' respectively, are such that, when the holder 28 is in its closed condition as shown in FIG. 6, the distance between the obverse faces of the first and second panels 30, 32 is sufficient for accommodating the combined thicknesses of two photo albums 10 or 10', while the distance between the obverse faces of the first and third panels 30, 34 is sufficient to accommodate the thickness of one photo album 10 or 10'. Accordingly, when the holder 28 is in its closed condition, the width of the inner face of the first spine 36 (including the transverse contribution of its hinges 38, 38') is approximately two-thirds the width of the inner face of the second spine 40 (including the transverse contribution of its associated longitudinal hinges 42, 42'). The thickness of a typical photo album 10 may be approximately one-half inch or less, so that the width of the inner face of the first spine 36 (including the transverse contribution of its associated longitudinal hinges 38, 38') is approximately one inch, while the width of the inner face of the second spine 40 (including the transverse contribution of its associated longitudinal hinges 42, 42') is approximately one and one-half inches.

Closure means may be provided, for example by a strap 70 extending from the free longitudinal edge of the third panel 34 cooperating with the outer face 46 of the album holder 28 for releasably securing the album holder 28 in its closed condition. As indicated in FIGS. 3–7, fastening means may include a first strip or patch 72 and a second strip or patch 74 of cooperating fastening material, such as marketed under the trademark VELCRO, respectively secured to the inner face 44 of the closure strap 70 and to a correspondingly mating location on the outer face 46 of the first spine 36. As is well known, VELCRO fasteners include a plastic hook device for mating with an included loop device when pressed into contact, so that the patch 72 may comprise the VELCRO hook device while the strip 74 may comprise the VELCRO loop device.

The outer face of the album holder's second spine 40 may have provided thereon a transparent pocket, such as a transparent vinyl sheet 76 welded along three edges to the spine 40 (or along the seams 42, 54, 42') and having a free edge or pocket opening 78 into which a card or label may be inserted for displaying indicia for identifying the album holder 28 and/or its photographic contents. The albums 10, 10' may be individually labeled for identification as well, such as by including an index number with label at the album's bound edge as disclosed in the aforementioned Rejwan patent, or by marking or labelling the album's front cover leaf 12 with identifying indicia.

Figure 8:
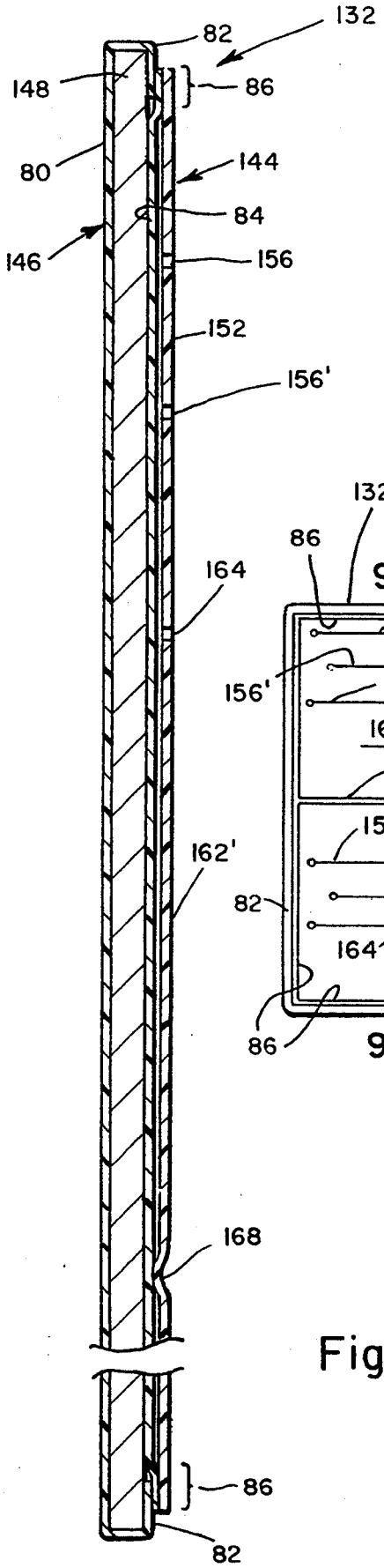
FIG. 8 is an elevation view of an inner face of an alternative two-panel embodiment of a photo album holder of the present invention in its open condition, also illustrating an alternative construction of the album holder.
Figure 9:
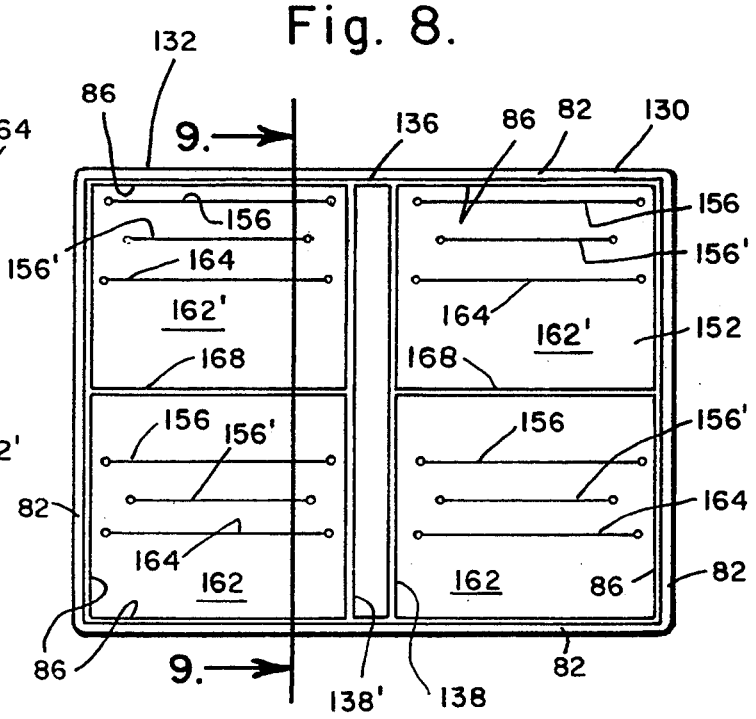
FIG. 9 is a fragmentary cross-sectional elevation view of a photo album holder constructed in accordance with the alternative construction illustrated in FIG. 8 and taken along the line 9—9 in the direction of the appended arrows.

An alternative manner of constructing the album holder of the present invention is illustrated in FIGS. 8 and 9, wherein the last two digits of the three-digit reference numerals are utilized to identify elements corresponding to elements of FIGS. 3 and 5 which are identified by corresponding two-digit referenced numerals. This alternative construction may be used for constructing a three-panel holder as in the preferred embodiment, notwithstanding that FIG. 8 shows such alternative construction utilized in a two-panel alternative embodiment of the present invention. It may be further appreciated that the construction previously described for constructing the three-panel holder of FIGS. 3 and 5 may be utilized for constructing a two-panel holder as well. The panels 130, 132 are preferably of the same dimensions as the panels 30, 32 previously described, and the spine 136 is preferably of the same dimensions as the first spine 36 previously described.

The alternative construction of each of the panels is represented by the longitudinal cross-section of the second panel 132 shown in FIG. 9. An outer cover sheet 80, which may be cloth or paper such as 50-pound book stock, is glued or otherwise caused to adhere to the outer surface of the substantially rigid rectangular panel core member 148, and adheredly extends over the top and bottom of the core 148 to provide an inner margin 82 (of, say, approximately one-half inch). The outer cover sheet 80 extends over and is glued to the outer surfaces of the other panel and spine core members, and adheredly extends over their tops and bottoms and about the free edges of the first and last panel core members such that the glued margin 82 extends along or from the entire periphery of the inner surface of the photo album holder as shown in FIG. 8.

As shown in FIG. 9, an inner flexible liner sheet 84, such as vinyl, is glued to the inner surface of the panel core member 148, adheredly extending over a portion (say, one-quarter inch) of the paper or cloth margin 82. The vinyl inner liner adheredly extends as well over the inner surfaces of the other panel and spine core members. Accordingly, the arrangement of panel cores and spine cores is adhesively or otherwise adheredly covered with and sandwiched between the flexible outer sheet 80 and the inner liner 84.

A vinyl inner cover sheet 152 (similar in physical characteristics to the vinyl cover sheet 52 previously described) covers the vinyl liner 84, and is secured along its edges to the edges of the liner 84, preferably by a peripheral welded heat seal 86. Additional longitudinal heat seals are provided for welding the inner cover 152 to the inner liner 84 along the spine hinges, as shown at 138, 138' in FIG. 8. Except where secured to the inner liner along the peripheral seal, the spine hinge seals and the pocket seal 168, the inner cover sheet 152 is non-adhesively applied to each panel such that a free space may be available between the vinyl liner 84 and the flexible inner cover sheet 152 as shown in FIG. 9.

The inner face 144 of each of the panels includes pairs of transverse slits 156, 156' through the vinyl inner cover sheet 152, which are similar to and serve the same function as the pairs of transverse slits 56, 56' previously described with respect to FIGS. 3 and 5. A further transverse slit 164 through the vinyl inner cover sheet 152 is situated below (as viewed in FIGS. 8 and 9) the pairs of transverse slits 156, 156', for example approximately one and five-eights inches below the upper slit 156. The slits 164 are pocket openings for pockets 162', 162, for receiving photo negatives, serving the same function as the Docket openings 64 and pockets 62', 62 previously described with respect to FIGS. 3 and 5. The bottom (as viewed in FIGS. 8 and 9) of each pocket 162' is formed by the horizontal heat seal 168 welding the inner cover sheet 152 to the liner 84 and the bottom of each pocket 162 is formed by the portion of the peripheral seal 86 extending along the bottom edge of the sheet 152.

In use, two photoprint albums and their respectively associated photo negatives packages may be retained by each of the two panels illustrated in FIG. 8, so that as many as four photo albums may be retained on the two panels along with their respectively corresponding photo negatives in localized association therewith.

Thus, there has been described a method and preferred embodiments of an apparatus for holding photoprint albums and corresponding photo negatives in localized association. Other embodiments and configurations of the photo album holder of the present invention may be developed without departing from the essential characteristics thereof. For example, seven-inch wide slits may be added to the pair of slits described in order to accommodate nominally 5"×7" prints, and in such case the longitudinal and transverse dimensions of each of the panels would be increased. Holders of other dimensions are of course possible; and other construction methods may be utilized for producing the album holder, such as molding, in addition to the gluing and welding methods disclosed. Further, holder embodiments for accommodating fewer or more than two albums per panel, or including more than three panels, are possible. Accordingly, the invention should be limited only by the scope of the claims listed below.

We claim:

1. Apparatus for holding photo albums, comprising in combination:

three substantially rectangular panels;

a first spine pivotally connecting a first one of said panels and a second one of said panels;

a second spine longitudinally parallel to said first spine pivotally connecting said second panel and a third one of said panels;

said panels being pivotable along said spines into a closed condition with said first panel overlapping said second panel and spaced therefrom along said first spine, and with said third panel overlapping said first panel and spaced therefrom along said second spine;

album retaining means carried by each of said panels for retaining photoprint albums thereon; and negatives storage means carried by each of said panels for storing photo negatives in localized association with respective ones of said album retaining means.

2. The apparatus according to claim 1, wherein:

said album retaining means and said negatives storage means carried by said first panel are obverse to said album retaining means and said negatives storage means carried by said second panel when said panels are in said closed condition.

3. The apparatus according to claim 1, wherein:

the width of said first spine is approximately two-thirds the width of said second spine.

4. The apparatus according to claim 1, further including:

closure means for releasably securing said panels in said closed condition.

5. The apparatus according to claim 4, wherein:

said closure means releasably secures said third panel to said first spine.

6. Photoprint album holder apparatus, comprising in combination:

three substantially rectangular panels;

a first spine pivotally connecting a first one of said panels and a second one of said panels, and a second spine longitudinally parallel to said first spine pivotally connecting said second panel and a third one of said panels;

said panels being pivotable along said spines into a closed condition with said first panel overlapping said second panel and spaced therefrom along said first spine with said photoprint albums on said first panel obverse to said photoprint albums on said second panel, and with said third panel overlapping said first panel and spaced therefrom along said second spine with said photoprint albums on said third panel obverse to said first panel;

a plurality of photoprint albums retained on said panels; and a plurality of pockets carried by said panels, said pockets respectively underlying said retained albums and containing photo negatives corresponding to photoprints in respective ones of said albums.

7. Photoprint album holder apparatus, comprising in combination:

a plurality of substantially rectangular panels;

a plurality of photoprint albums retained on said panels;

means successively connecting said panels such that said panels are pivotable into a closed condition with said panels overlapping one another and spaced for accommodating said retained photoprint albums between overlapping ones of said panels.

8. The apparatus according to claim 7, further including:

negatives storage means carried by said panels, ones of said negatives storage means being in localized association with ones of said retained photoprint albums respectively.

9. The apparatus according to claim 7, further including:

a plurality of pockets carried by said panels for storing photo negatives, said pockets arranged in localized association with said retained photoprint albums respectively.

10. The apparatus according to claim 9, wherein:

said pockets respectively underlie said retained photoprint albums.

11. The apparatus according to claim 9, wherein each of said photoprint albums include a plurality of photoprints; and further including photoprints contained in ones of said pockets respectively associated with ones of said retained albums having photoprints corresponding to the contained negatives.

12. The apparatus according to claim 7, further including:

album retaining means carried by said panels releasably retaining said photoprint albums on said panels.

13. The apparatus according to claim 12, further including:

negatives storage means carried by said panels, ones of said negatives storage means being in localized association with ones of said album retaining means respectively.

14. The apparatus according to claim 8, wherein:

each of said photoprint albums includes a rear flap and a plurality of photoprints pivotally depending along said flap; and at least one receiving means on each of said panels for receiving the rear flap of a one of said photoprint albums for releasably retaining said one album on a one of said panels.

15. The apparatus according to claim 10, wherein:

each of said photoprint albums includes a rear flap and a plurality of photoprints pivotally depending along said flap;

each of said panels includes a substantially rectangular rigid core and a flexible sheet covering a surface of said rigid core; and each of said panels includes at least one slit in said sheet for receiving a rear flap included by a one of said photoprint albums between said sheet and said core surface for releasably retaining said one album on a one of said panels.

16. The apparatus according to claim 10, wherein:

each of said photoprint includes a rear flap and a plurality of photoprints pivotally depending from said flap; and at least two receiving means on each of said panels for respectively receiving flaps of different dimensions for accommodating photoprint albums of different dimensions.

17. The apparatus according to claim 12, wherein:

the number of said panels of said plurality is two; and said means successively connecting said panels includes a spine pivotally connecting a first one of said panels and a second one of said panels, said panels pivotable along said spine into a closed condition with said first panel overlapping said second panel and spaced therefrom along said spine.

18. The apparatus according to claim 17, further including:

a plurality of pockets carried by said panels for storing photo negatives, ones of said pockets arranged in localized association with ones of said album retaining means respectively.

19. The apparatus according to claim 12, wherein:

the number of said panels of said plurality is three;

said means successively connecting said panels includes a first spine pivotally connecting a first one of said panels and a second one of said panels, and a second spine longitudinally parallel to said first spine pivotally connecting said second panel and a third one of said panels; and said panels being pivotable along said spines into a closed condition with said first panel overlapping said second panel and spaced therefrom along said first spine, and with said third panel overlapping said first panel and spaced therefrom along said second spine.

20. The apparatus according to claim 19, further including:

a plurality of pockets carried by said panels for storing photo negatives, ones of said pockets arranged in localized association with ones of said album retaining means respectively.

21. A method for storing photoprints and photo negatives corresponding thereto, comprising the steps of:

providing a plurality of photo albums each including a plurality of photoprints;

providing a plurality of photo negatives packages each including photo negatives respectively corresponding to the photoprints of respective ones of said photo albums;

providing a photo album holder comprising a plurality of substantially rectangular panels, means successively connecting said panels such that said panels are pivotable into a closed condition with said panels in spaced overlapping arrangement, a plurality of retaining means carried by said panels for cooperating with said photo albums for retaining respective ones of said albums on said panels, and a plurality of pockets carried by said panels in localized association with respective ones of said retaining means;

engaging a one of said photo albums with a one of said retaining means for being retained on a one of said panels;

selecting a one of said photo negatives packages including photo negatives corresponding to the photo-prints of said one retained photo album; and inserting said one selected photo negatives package in the one of said pockets in localized association with said one retained photo album.

22. The method according to claim 21, wherein:

during said photo album holder providing step, said pockets of said provided photo album holder are carried by said panels such that said pockets respectively underlie ones of said albums when retained by said retaining means; and during said negatives insertion step, inserting said selected negatives package in the one of said pockets underlying said one retained album.

23. The method according to claim 22, further including the steps of:

engaging other ones of said photo albums with respective other ones of said retaining means for being retained on said panels;

selecting other ones of said photo negatives packages respectively including photo negatives corresponding to the photoprints of said other retained photo albums; and inserting said other ones of said selected photo negatives packages in the ones of said pockets underlying the respectively corresponding other ones of said retained photo albums.

24. The method according to claim 23, wherein during said photo album holder providing step, the number of said panels of said plurality of said panels is two, and said means successively connecting said panels includes a spine pivotally connecting a first one of said panels and a second one of said panels;

further including the step of pivoting said first panel along said spine for overlapping said second panel with said photo albums retained on said first and second panels contained within the space between said overlapping first and second panels.

25. The method according to claim 23, wherein during said photo album holder providing step, the number of said panels of said plurality of said panels is three, and said means successively connecting said panels includes:

a first spine pivotally connecting a first one of said panels and a second one of said panels, and a second spine longitudinally parallel to said first spine pivotally connecting said second panel and a third one of said panels;

further including the steps of:

pivoting said first panel along said first spine for overlapping said second panel with said photo albums retained on said first and second panels contained within the space between said overlapping first and second panels, and pivoting said third panel along said second spine for overlapping said first panel with said photo albums retained on said third panel contained within the space between said overlapping third and first panels.

26. The method according to claim 21, wherein:

during said photo albums providing step, said provided photo albums each include a rear flap and a plurality of photoprints hingedly depending along said flap;

during said photo album holder providing step, said retaining means carried by said panels of said provided album holder includes means for receiving ones of said rear flaps for thereby retaining said respective ones of said albums on said panels; and during said engaging step, inserting the rear flap of said one photo album for being received by said one retaining means and retaining said one photo album on said one panel.

27. The method according to claim 26, wherein:

during the photo album holder providing step, said pockets of said provided photo album holder are carried by said panels such that they respectively underlie ones of said albums when retained by said retaining means; and during said negatives insertion step, inserting said selected negatives package in the one of said pockets underlying said one retained album.

28. The method according to claim 27, further including the steps of:

inserting other ones of said flaps for being received by respective other ones of said retaining means;

selecting other ones of said photo negatives packages respectively including photo negatives corresponding to the photoprints of said other retained photo albums; and inserting said other ones of said selected photo negatives packages in the ones of said pockets underlying the respectively corresponding other ones of said retained photo albums.

29. The method according to claim 28, wherein during said photo album holder providing step, the number of said panels of said plurality of said panels is three, and said means successively connecting said panels includes:

a first spine pivotally connecting a first one of said panels and a second one of said panels, and a second spine longitudinally parallel to said first spine pivotally connecting said second panel and a third one of said panels;

further including the steps of:

pivoting said first panel along said first spine for overlapping said second panel with said photo albums retained on said first and second panels contained within the space between said overlapping first and second panels, and pivoting said third panel along said second spine for overlapping said first panel with said photo albums retained on said third panel contained within the space between said overlapping third and first panels.

* * * * *